US006648448B1

(12) United States Patent
Ma et al.

(10) Patent No.: US 6,648,448 B1
(45) Date of Patent: Nov. 18, 2003

(54) WASTE INK MANAGEMENT SYSTEM FOR AN INK JET PRINTER

(75) Inventors: Nai-Hsiung Ma, Hsinchu (TW); Shirley Flynn Mitchell, Lexington, KY (US); Tasha Monique Sims, Lexington, KY (US); Patrick Lawrence Ransom, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/570,607

(22) Filed: May 12, 2000

(51) Int. Cl.[7] ..... B41J 2/165
(52) U.S. Cl. ..... 347/32
(58) Field of Search ..... 347/32, 33, 36, 347/35

(56) References Cited

U.S. PATENT DOCUMENTS 5,396,271 A * 3/1995 Premnath ..... 347/33
5,517,222 A 5/1996 Sugiyama et al.
5,539,435 A * 7/1996 Uchida et al. ..... 347/33
5,563,637 A 10/1996 Francis et al.
5,612,722 A 3/1997 Francis et al.
5,614,930 A 3/1997 Osborne et al.
5,617,124 A 4/1997 Taylor et al.
5,627,573 A 5/1997 Fahy
5,627,574 A 5/1997 Fahy
5,640,182 A 6/1997 Bahrami et al.
5,712,668 A 1/1998 Osborne et al.
5,742,303 A 4/1998 Taylor et al.
5,760,802 A 6/1998 Ebinuma et al.
5,774,139 A * 6/1998 Salzer et al. ..... 347/32
5,847,728 A 12/1998 Lee
5,867,185 A 2/1999 Yun
5,886,714 A 3/1999 Burney et al.
5,896,145 A 4/1999 Osborne et al.
5,905,513 A 5/1999 Brandon et al.
5,905,514 A 5/1999 Rhoads et al.
5,946,009 A 8/1999 Youn
5,949,448 A 9/1999 Man et al.
5,963,229 A 10/1999 Fukuoka
5,966,146 A 10/1999 Lee
6,322,196 B1 * 11/2001 Lim ..... 347/36 X
6,536,867 B1 * 3/2003 James et al. ..... 347/36

* cited by examiner

*Primary Examiner*—Michael Nghiem
(74) *Attorney, Agent, or Firm*—Taylor & Aust, P.C.

(57) ABSTRACT

A maintenance unit for use in an ink jet printer having a printer frame and a waste ink accumulation region includes a maintenance frame coupled to the printer frame. A maintenance sled is moveably coupled to the maintenance frame. A spreader mechanism is slidably coupled to the maintenance frame, and is driveably coupled to the maintenance sled. The spreader mechanism contacts waste ink to distribute the waste ink over the waste ink accumulation region as the maintenance sled moves relative to the maintenance frame.

19 Claims, 5 Drawing Sheets

WASTE INK MANAGEMENT SYSTEM FOR AN INK JET PRINTER

BACKGROUND OF THE INVENTION

1. Field of the Invention

The present invention is directed generally to the management of waste ink accumulated in an ink jet printer, and more particularly, to an apparatus and method for increasing the effective capacity for storing waste ink in a maintenance station without increasing the physical capacity of the waste ink collection reservoir.

2. Description of the Related Art

Maintenance operations are required by ink jet printers to keep the nozzles of the print cartridge operating properly. Typically, such maintenance operations include a combination of wiping the nozzle area of the print cartridge, firing the nozzles at prescribed intervals (spitting), and capping the cartridge during idle periods to prevent the jetted ink which remains on the nozzle plate from evaporating and drying on the nozzle plate, which in turn can clog one or more of the nozzles of the nozzle plate. Typically, the spitting operation occurs at a location in the maintenance station. Thus, the maintenance station includes some sort of reservoir for accumulating waste ink.

A variety of attempts have been made to handle and transfer waste ink in an ink jet system. One such attempt is directed to an apparatus having a pump mechanism for carrying waste ink from the pump to a carrying member. Waste ink is supplied to the pump by a series of ink-absorbing materials that, by capillary action, transfer the waste ink to the pump. During operation, a print head wiper slides in contact with a wipe-over portion of an ink-absorbing member carried by an ink-absorbing spring at a predetermined position on the chassis, whereby ink, water droplets, and contaminants adhering to the wiper are imparted to the ink-absorbing member. The ink or water droplets adhering to the ink-absorbing members transfer from one member to another by capillary action, and ultimately to the pump mechanism for carrying waste ink from the pump to a waste ink carrying member.

Early ink jet printers used dye-based inks, which were mostly volatile liquids, and the maintenance operations required little capacity for waste ink generated from the spitting operation due to evaporation of the volatile liquid component of the ink and the relatively small quantity of solids in the ink. More recent products, however, have incorporated pigment-based inks that have a larger percentage of solids in them. After the volatile components evaporate, a sludge of mostly solid material is left behind. This solid material builds up in or below the maintenance assembly, and over time, storage capacity must be provided for the solid buildup in order for the maintenance station of the printer to operate properly. To address this increase in capacity, one method would be to increase the size of the waste ink collection reservoir for collecting the waste ink. Such an increase in capacity for collecting waste ink, however, would result in increased size of the printer and/or increased cost relating to the increased capacity for the waste ink collection reservoir.

What is needed in the art is a printing system that includes a maintenance station that has the ability-to effectively increase the amount of waste ink that can be collected without physically increasing the size of the waste ink collection reservoir.

SUMMARY OF THE INVENTION

The present invention provides a maintenance unit for use in an ink jet printer having a printer frame and having a waste ink accumulation region.

In one form of the invention, the maintenance unit includes a maintenance frame coupled to the printer frame; a maintenance sled moveably coupled to the maintenance frame; and a spreader mechanism slidably coupled to the maintenance frame. The spreader mechanism is driveably coupled to the maintenance sled. The spreader mechanism contacts waste ink to distribute the waste ink over the waste ink accumulation region as the maintenance sled moves relative to the maintenance frame.

As one aspect of the invention, the spreader mechanism is controllably moved horizontally with respect to the maintenance frame.

As another aspect of the invention, the spreader mechanism is controllably moved both horizontally and vertically with respect to the maintenance frame.

An advantage of the present invention is that the amount of waste ink that can be collected without physically increasing the size of the waste ink collection reservoir is increased.

Another advantage is that the service life of an ink jet printer into which the present invention is incorporated is increased.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
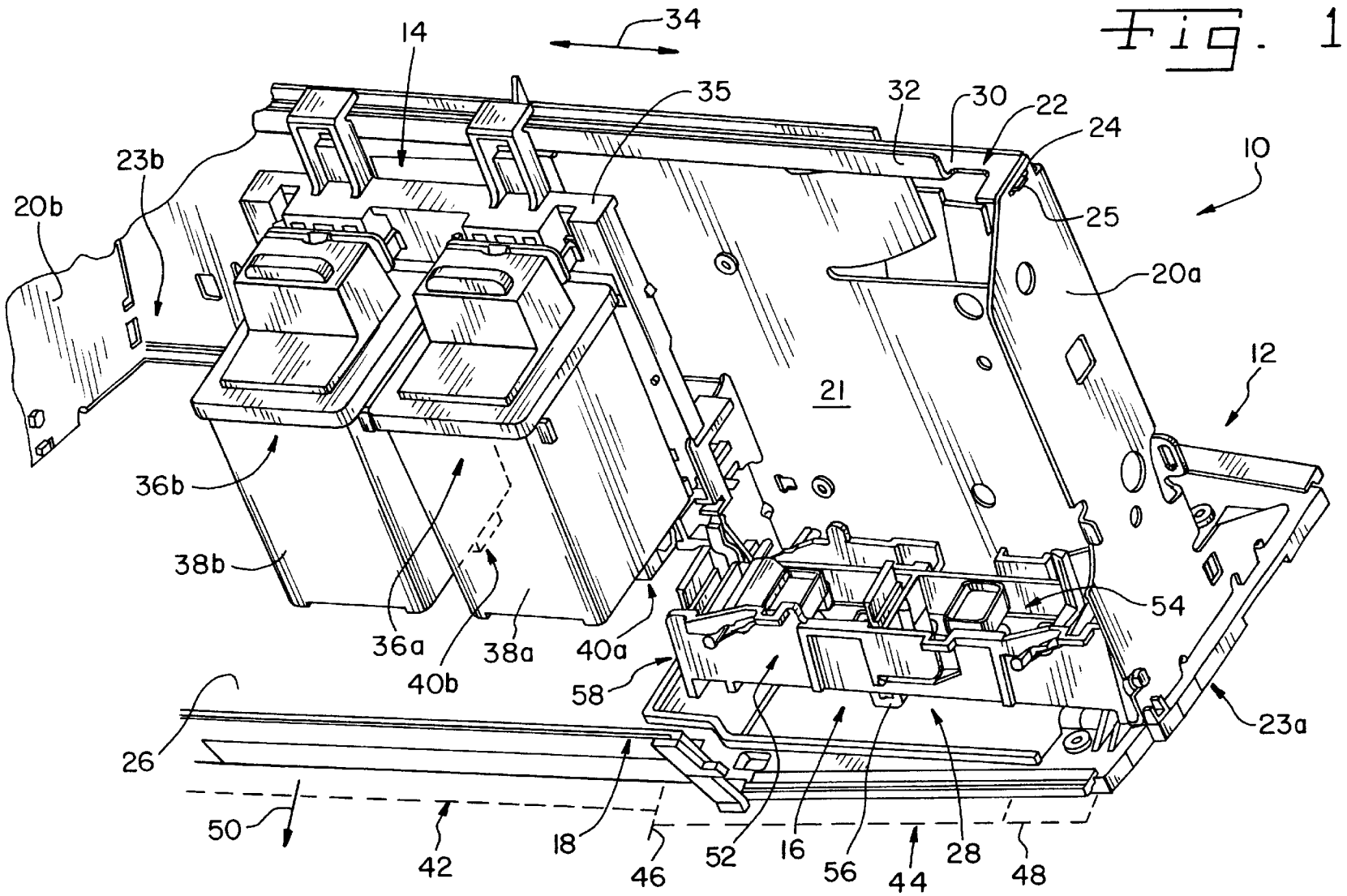
FIG. 1 is a partial, perspective view of the frame assembly of an ink jet printer including a maintenance assembly in accordance with the invention.

Referring now to the drawings and particularly to FIG. 1, there is shown a portion of an ink jet printer 10 that includes a printer frame 12, a printhead carrier assembly 14, and a maintenance assembly 16 in accordance with the present invention. Positional terms such as left, right, top, bottom, upper, lower, clockwise or counter-clockwise are assigned based on the orientation of printer 10 in FIG. 1 and should not be considered limiting terminology.

Printer frame 12 includes a bottom frame member 18, two side frame members 20*a*, 20*b*, a rear frame member 21, and a top frame member 22. Side frame members 20*a*, 20*b* are attached to, and extend generally vertically upwardly from, opposing ends 23*a*, 23*b* of bottom frame member 18. An upper portion of each of the side frame members 20*a*, 20*b* includes a slot 24 which is adapted to accept a tab 25 of top frame member 22 to mount and position top frame member 22 generally parallel to bottom frame member 18. Rear frame member 21 is disposed between side frame members 20*a*, 20*b*, generally above bottom frame member 18 and below top frame member 22. An upper surface 26 of bottom frame member 18 includes a waste ink accumulation region 28.

Top frame member 22 includes a horizontally extending guide portion 30 and a vertically upwardly extending guide rail 32 disposed at the rear side of guide portion 30. Guide rail 32 is adapted to slideably receive printhead carrier assembly 14 and permit reciprocating movement of printhead carrier assembly 14 in relation to guide rail 32 in the directions depicted by arrows 34.

Printhead carrier assembly 14 includes a carriage 35 which holds two print cartridges 36*a*, 36*b*, wherein print cartridge 36*a* contains a magenta, yellow and cyan colored pigment based inks and print cartridge 36*b* contains a black dye based ink. In general, pigment based inks contain more solid components than dye based inks.

Each of print cartridges 36*a*, 36*b* includes an ink reservoir 38*a*, 38*b* and a printhead 40*a*, 40*b*, respectively. Each of printheads 40*a*, 40*b* includes a nozzle plate (not shown) containing a plurality of nozzle openings (not shown) for selectively ejecting ink from the corresponding ink reservoirs 38*a*, 38*b*. Although ink reservoirs 38*a*, 38*b* and printheads 40*a*, 40*b*, respectively, are shown as forming an integral unit, i.e., print cartridges 36*a*, 36*b*, those skilled in the art will recognize that the reservoir may be mounted remotely from the printhead and connected to the printhead via a conduit. In such a configuration, printhead carrier assembly 14 would not need to carry the ink reservoir.

The reciprocating movement of printhead carrier assembly 14 along guide rail 32 is effected by a drive means (not shown) of a type known in the art, such as a belt coupled to a stepper motor. The movement of printhead carrier assembly 14 and the ejection of ink by print cartridges 36*a*, 36*b* are controlled by a microprocessor control means, types of which are known in the art. During operation, printhead carrier assembly 14 is moved by the drive means to position printheads 40*a*, 40*b* at various locations within the predetermined limits of permitted travel of printhead carrier assembly 14. Included in the limited travel of printhead carrier assembly 14 is a printing zone 42, and a maintenance zone 44 defined by a maintenance start position 46 and a capping region 48.

Printing operations occur in a conventional manner that is well understood in the art. A sheet of print media, such as paper, is carried under printheads 40*a*, 40*b*, but above bottom frame member 18. The sheet is carried by a series of rollers (not shown) in the direction shown by arrow 50. The sheet typically has a constant separation from printheads 40*a*, 40*b* . As the sheet is being carried, printheads 40*a*, 40*b* reciprocally traverse printing zone 42. Under the control and at locations selected by a microprocessor control means, print cartridges 36*a*, 36*b* selectively eject ink from the respective nozzles of printheads 40*a*, 40*b* onto the sheet.

During a maintenance operation, printheads 40*a*, 40*b* are moved into maintenance zone 44 to have a maintenance cycle performed. Two types of maintenance cycles are possible: a printing maintenance cycle and a printhead storage maintenance cycle. Both types of maintenance cycles, i.e., the printing maintenance cycle and the printhead storage maintenance cycle, are effected by maintenance assembly 16.

Maintenance assembly 16 is attached to printer frame 12 above waste ink accumulation region 28 of bottom frame member 18. Maintenance assembly 16 includes a maintenance frame 52, a maintenance sled 54 and a waste ink spreader 56. Preferably, maintenance assembly 16 is located such that a left end 58 of maintenance sled 54 generally defines maintenance start position 46 for printhead carrier assembly 14.

Figure 2:
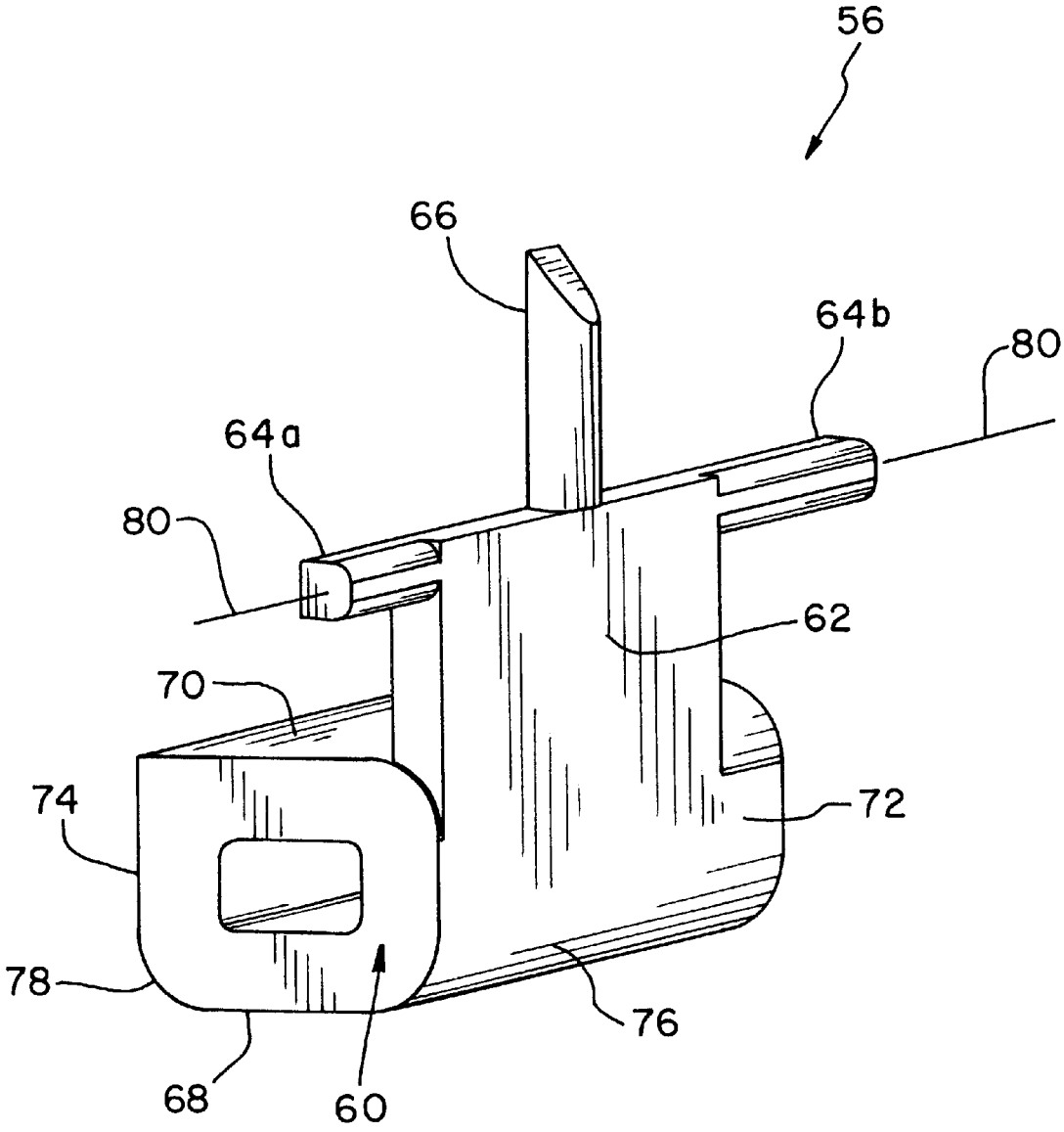
FIG. 2 is a perspective view of the waste ink spreader used in the maintenance assembly of FIG. 1.

FIG. 2 shows waste ink spreader 56 removed from maintenance sled 54 of maintenance assembly 16. Waste ink spreader 56 includes a spreader body 60, an extension member 62, a pair of guide pins 64*a*, 64*b*, and a drive pin 66.

Spreader body 60 is formed as a generally box-shaped structure having a bottom side 68, a top side 70, a leading side 72 and a trailing side 74. Leading side 72 smoothly transitions into bottom side 68 to form a leading curved surface 76. Also, trailing side 74 smoothly transitions into bottom side 68 to form a trailing curved surface 78. Referring to FIG. 1, waste ink spreader 56 is positioned in maintenance sled 54 so that trailing side 72 and trailing curved surface 78 face toward the left end 58 of maintenance sled 54.

Extending co-planarly upward from leading side 72 is extension member 62. Extending co-axially outward from an upper portion of extension member 62 along axis 80 are guide pins 64*a* and 64*b*. Extending upwardly from an upper central portion of extension member 62 is drive pin 66.

Waste ink spreader 56 is disposed within the open interior of maintenance frame 52 and within the open interior of maintenance sled 54. Drive pin 66 is configured to be slidably received by an aperture of maintenance sled 54 such that the lateral (side-to-side) movement of maintenance sled 54 will result in a corresponding horizontal movement of waste ink spreader 56, while permitting independent vertical movement of waste ink spreader 56.

Figure 3:
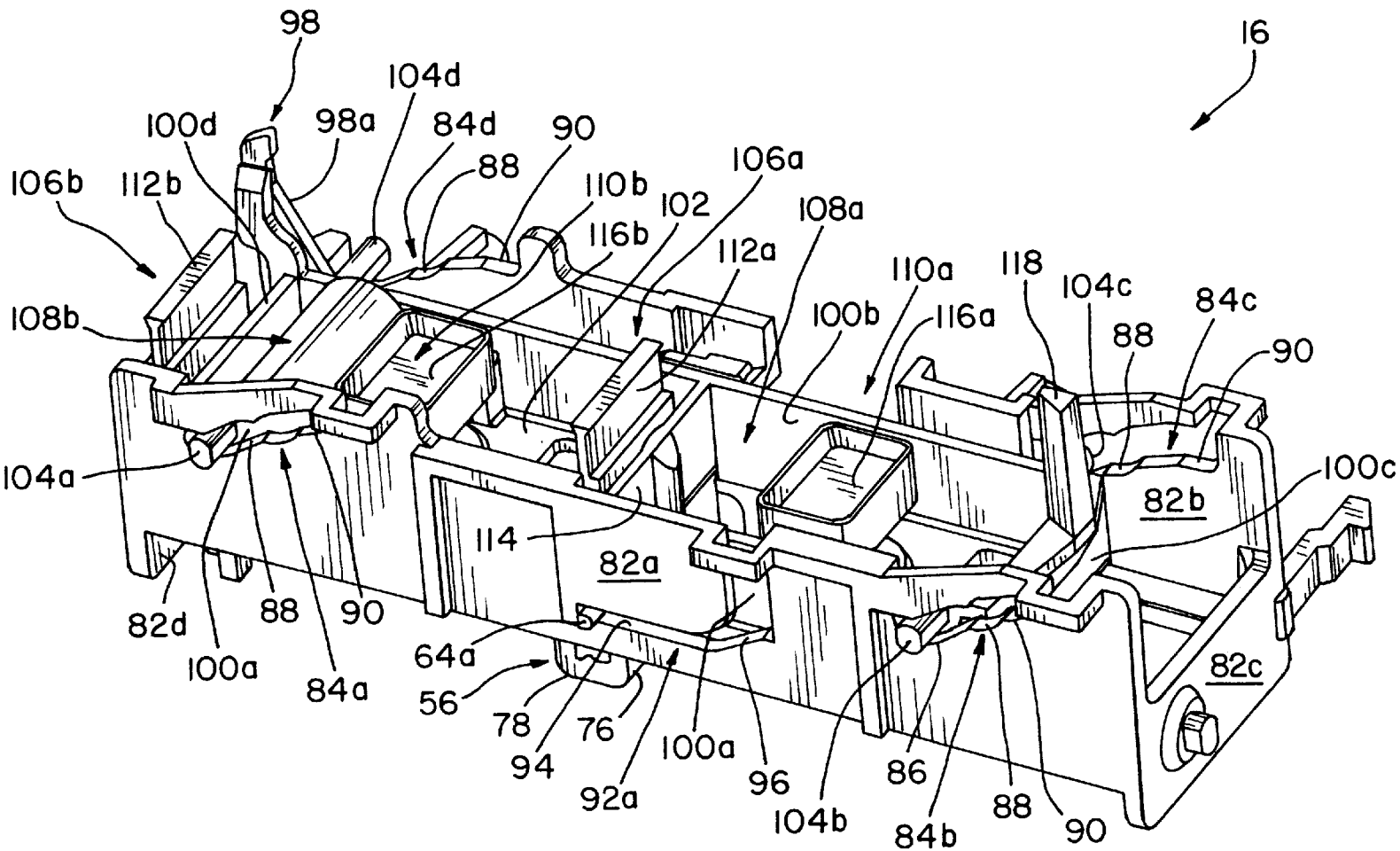
FIG. 3 is a perspective view of the maintenance assembly of FIG. 1 with the waste ink spreader positioned in the lowered position.
Figure 4:
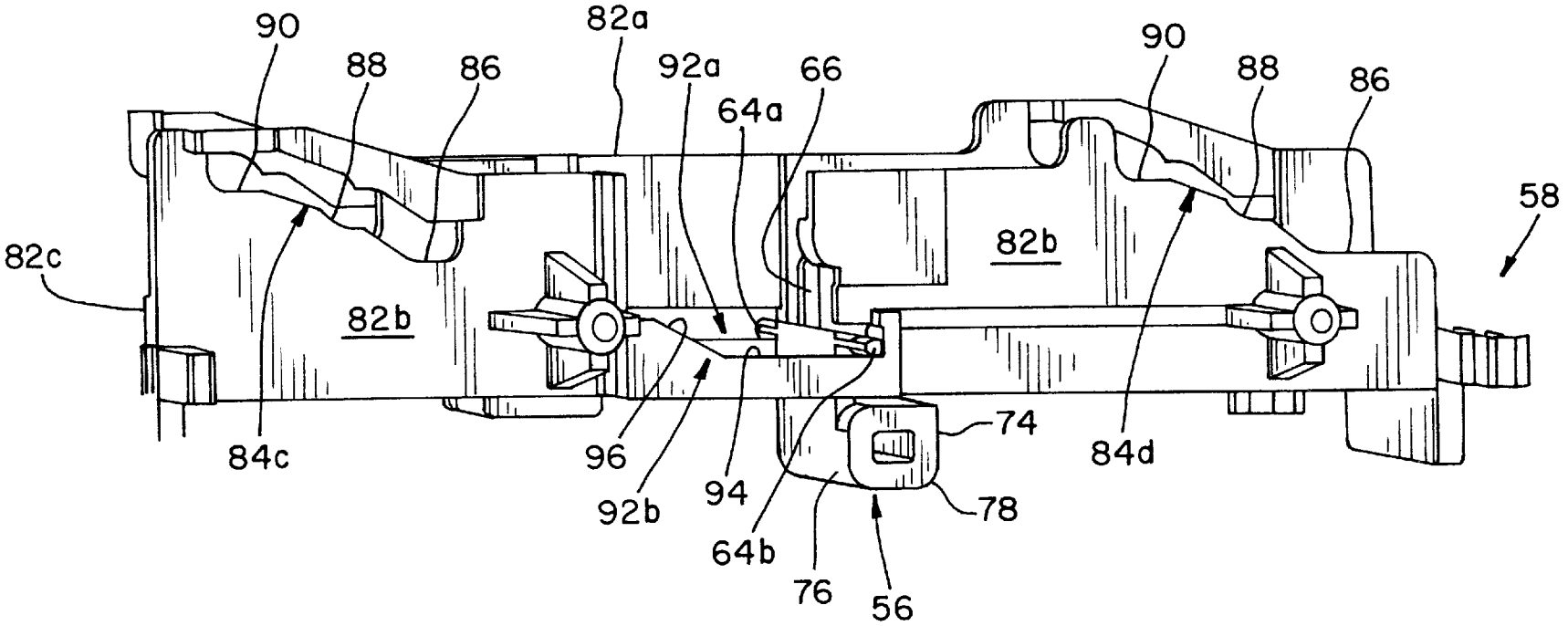
FIG. 4 is a reversed perspective view of the maintenance assembly of FIG. 3 with the maintenance sled removed to more clearly show the waste ink spreader positioned in the lowered position.
Figure 5:
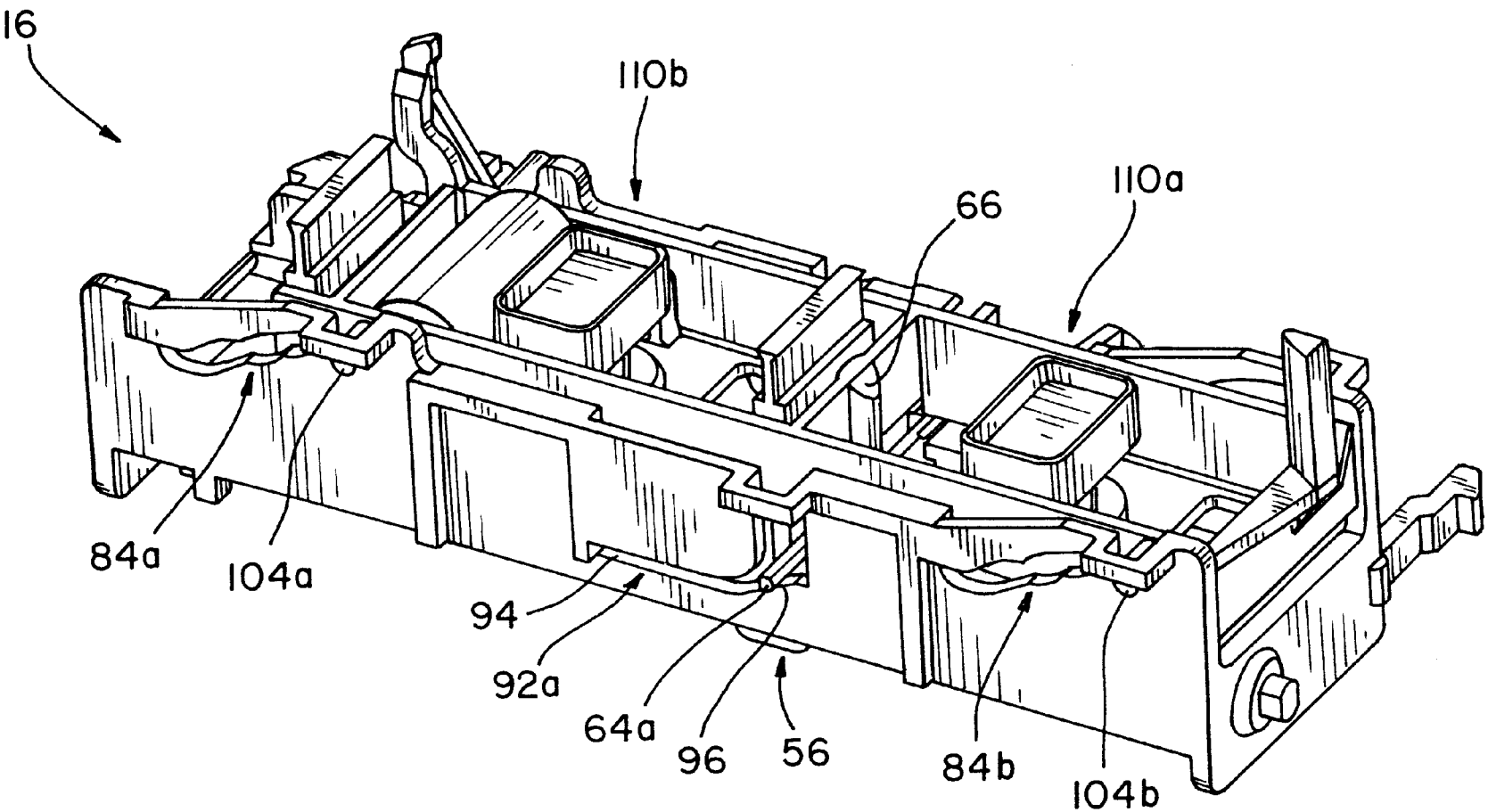
FIG. 5 is a perspective view of the maintenance assembly of FIG. 1 with the waste ink spreader positioned in the raised position.

Referring to FIGS. 3–5, maintenance frame 52 is a generally rectangular structure formed by vertical guide members 82*a*, 82*b*, 82*c*, and 82*d*. Vertical guide member 82*a* includes two ramped surfaces 84*a*, 84*b* and vertical guide member 82*b* includes two ramped surfaces 84*c*, 84*d*. Ramped surfaces 84*a*, 84*b*, 84*c*, 84*d* provide vertical support for maintenance sled 54. Each of ramped surfaces 84*a*, 84*b*, 84*c*, 84*d* is upwardly inclined towards vertical member 82*c* and each contains three distinct elevations: a printing elevation 86; a wiping elevation 88; and capping elevation 90.

Vertical guide member 82*a* of maintenance frame 52 further includes a guide surface 92*a* (FIG. 3) and vertical guide member 82*b* of maintenance frame 52 further includes a guide surface 92*b* (FIG. 4). Guide surfaces 92*a*, 92*b* provide vertical support for guide pins 64*a*, 64*b*, respectively, of waste ink spreader 56. Each of guide surfaces 92*a*, 92*b* has a lower horizontal elevation 94 and an inclined elevation 96. Thus, as can be most clearly seen in FIG. 4, guide pins 64*a*, 64*b* of waste ink spreader 56 are slidably carried by the vertical support provided by guide surfaces 92*a*, 92*b*, respectively, along the extent of lower horizontal elevation 94 and inclined elevation 96.

Maintenance frame 52 further includes a print latch 98 pivotally coupled at the intersection of vertical guide members 82*b*, 82*d*. Print latch 98 contains a stop surface 98*a* and a spring (not shown). Print latch 98 functions to actively control the placement of maintenance sled 54 along ramped surfaces 84*a*, 84*b*, 84*c*, 84*d*. When print latch 98 is in the open position, sled 54 is allowed to travel along ramped surfaces 84*a*, 84*b*, 84*c*, 84*d* to printing elevation 86. When print latch 98 is in the closed position, sled 54 is prohibited from traveling along ramped surfaces 84*a*, 84*b*, 84*c*, 84*d* to printing elevation 86. The spring biases print latch 98 towards the closed position. The structure and operation of print latch 98 is well known in the art.

Maintenance sled 54 is disposed within the open interior of maintenance frame 52. Maintenance sled 54 has four generally vertical members 100*a*, 100*b*, 100*c* and 100*d* that form a rectangular structure. Maintenance sled 54 further includes a bottom horizontal member 102, and four dowel members 104*a*, 104*b*, 104*c* and 104*d*. Dowel members 104*a*, 104*b* extend horizontally, outward from vertical member 100*a* and dowel members 104*c*, 104*d* extend horizontally, outward from vertical member 100*b*. Dowel members 104*a*, 104*b*, 104*c*, 104*d* are supported by the corresponding ramped surfaces 84*a*, 84*b*, 84*c*, 84*d* on maintenance frame 52 and are guided along ramped surfaces 84*a*, 84*b*, 84*c*, 84*d* to raise or lower maintenance sled 54 relative to maintenance frame 52.

Maintenance sled 54 includes wiper assemblies 106*a*, 106*b* ; discharge regions 108*a*, 108*b*; and cap assemblies 100*a*, 100*b*. Each wiper assembly 106*a*, 106*b* is attached to bottom member 102 of maintenance sled 54 and includes a wiper 112*a*, 112*b*, respectively, made of an elastomeric material such as Texin 480-A (Mites, Inc.). Wiper assemblies 106*a*, 106*b* remove excess ink from the exterior of the nozzles on printheads 40*a*, 40*b*, respectively.

Discharge regions 108*a*, 108*b*, are located to the right of wiper assemblies 106*a*, 106*b*, respectively. Discharge region 108*a* forms a cavity defined by the combination of a vertical member 114 and vertical side members 100*a*, 100*b* of maintenance sled 54. As shown, discharge region 108*b* includes a rotary drum having an ink collection surface that is cleaned by a scraper that contacts the ink collection surface of the rotary drum. However, alternatively, the rotary drum could be removed to form a discharge cavity though which purged ink expelled by printhead 40*b* would pass.

Cap assemblies 110*a*, 110*b* are positioned to the right of discharge regions 108*a*, 108*b*. Cap assemblies 110*a*, 110*b* include printhead caps 116*a*, 116*b*.

Maintenance sled 54 further includes a capping tab 118 that extends vertically upward from vertical member 100*c*. Capping tab 118 facilitates the movement of sled 54 to wiping elevation 88 or to capping elevation 90 of ramped surfaces 84*a*, 84*b*, 84*c*, 84*d* when contacted by print cartridge 36*a*.

As maintenance sled 54 moves from left to right, waste ink spreader 56 moves from left to right, thereby spreading the accumulated ink generally to the right as the accumulated ink contacts leading curved surface 76 of spreader body 60. A right to left movement of maintenance sled 54 causes waste ink spreader 56 to spread the accumulated ink generally to the left as the accumulated ink contacts trailing curved surface 78 spreader body 60.

The operation of the waste ink spreader 56 will now be discussed in relation to the maintenance cycles, i.e., the printing maintenance cycle and printhead storage maintenance cycle, and will be discussed with reference to FIGS. 1–5.

In a printing maintenance cycle, printhead carrier assembly 14 moves to the right along guide rail 32 (FIG. 1) to maintenance region 44. Printhead carrier assembly 14 passes maintenance start position 46 and as printhead carrier assembly 14 moves farther to the right, the rightward leading print cartridge 36*a* contacts capping tab 118 (FIG. 3) of maintenance sled 54. This contact causes maintenance sled 54 to move to the right with the printhead carrier assembly 14. The rightward movement causes print latch 98 to momentarily reside in the open position thereby releasing sled 54 from printing elevation 86. The rightward movement raises maintenance sled 54 to wiping elevation 88 because dowel members 104*a*, 104*b*, 104*c*, 104*d* of maintenance sled 54 are guided along ramped surfaces 84*a*, 84*b*, 84*c*, 84*d*. In addition, the rightward movement of maintenance sled 54 causes waste ink spreader 56 to move rightward in conjunction with the generally lateral movement of maintenance sled 54 in a generally horizontal path because guide pins 64*a*, 64*b* are guided by the lower horizontal elevation 94 of guide surfaces 92*a*, 92*b*. During the rightward movement of waste ink spreader 56, leading curved surface 76 engages and disperses, or spreads, the accumulated ejected ink in waste ink accumulation region 28.

Once sled 54 reaches wiping elevation 88, print latch 98 resumes the closed position thereby impeding sled 54 from traveling back down ramped surfaces 84*a*, 84*b*, 84*c*, 84*d* to printing elevation 86 due to stop surface 98*a* on print latch 98. Although sled 54 has been raised to the wiping elevation due to the influence of ramped surfaces 84*a*, 84*b*, 84*c*, 84*d*, waste ink spreader 56 is not raised and travels on a generally horizontal path due to the influence of lower horizontal elevation 94 of guide surfaces 92*a*, 92*b*. After print latch 67 resumes the closed position, printhead carrier assembly 14 begins to travel back to the left towards printing zone 42. As print cartridges 36*a*, 36*b* pass over discharge regions 108*a*, 108*b*, respectively, ink is ejected from the nozzles in printheads 40*a*, 40*b* . The ejected ink falls through discharge regions 108*a*, 108*b* and accumulates in waste ink accumulation region 28. As printhead carrier assembly 14 moves father to the left, the nozzles of printheads 40*a*, 40*b* are wiped by wipers 112*a*, 112*b* to remove excess ink from the nozzles and a portion of the leftward leading print cartridge 36*b* contacts print latch 98 causing print latch 98 to assume the open position. Once print latch 98 is in the open position, dowel members 104*a*, 104*b*, 104*c*, 104*d* of maintenance sled 54 migrate down ramped surfaces 84*a*, 84*b*, 84*c*, 84*d* from wiping elevation 88 to printing elevation 86 due to gravity. After printhead carrier assembly 14 has completely entered printing zone 42, print latch 98 resumes the closed position due to the spring bias of print latch 98.

During the leftward movement of maintenance sled 54, waste ink spreader 56 is caused to move leftward in conjunction with the generally lateral movement of maintenance sled 54 in a generally horizontal path because guide pins 64*a*, 64*b* are guided by the lower horizontal elevation 94 of guide surfaces 92*a*, 92*b*. During the leftward movement of waste ink spreader 56, trailing curved surface 78 of waste ink spreader 56 further engages and disperses the accumulated ejected ink in waste ink accumulation region 28.

The printhead storage maintenance cycle is generally analogous to the printing maintenance cycle, except that printhead carrier assembly 14 does not stop its rightward motion when maintenance sled 54 is at wiping elevation 88. Instead, as shown in FIG. 5, printhead carrier assembly 14 continues to move to the right, thereby further moving maintenance sled 54 to the right until dowels 104*a*, 104*b*, 104*c*, 104*d* of sled 54 are at capping elevation 90 of ramp surfaces 84*a*, 84*b*, 84*c*, 84*d*. When maintenance sled 54 is at capping elevation 90 (defined as being in capping region 48), caps 116*a*, 116*b*, respectively form an air seal around the nozzles on printheads 40*a*, 40*b* to prevent the ink on the nozzles from drying. Printhead carrier assembly 14 can stay at capping region 48 for an indefinite amount of time.

The rightward movement of maintenance sled 54 during the printhead maintenance cycle causes waste ink spreader 56 to move rightward in conjunction with the generally lateral movement of maintenance sled 54, first in a generally horizontal path because guide pins 64*a*, 64*b* are guided by the lower horizontal elevation 94 of guide surfaces 92*a*, 92*b*, and then on a generally inclined path as guide pins 64*a*, 64*b* are guided by inclined elevation 96 of guide surfaces 92*a*, 92*b*. Thus, during the rightward movement of waste ink spreader 56, leading curved surface 76 engages and disperses the accumulated ejected ink in waste ink accumulation region 28. However, at the later extent of this lateral travel waste ink spreader 56 also moves vertically due to the incline of inclined elevation 96 to thereby ramp upwardly the waste ink being spread. By including this vertical movement of waste ink spreader 56, the waste ink storage capacity of maintenance assembly 16 is increased by about 25 percent over that if only horizontal movement along lower horizontal elevation 94 was used.

Once printhead carrier assembly 14 begins to move to the left toward printing zone 42, maintenance sled 54 migrates down ramp surfaces 84*a*, 84*b*, 84*c* 84*d* from capping elevation 90 to wiping elevation 88 thereby disengaging caps 116*a*, 116*b* from the respective printheads 40*a*, 40*b* . As stated earlier printheads 40*a*, 40*b* eject, or spit, ink from the nozzles through discharge regions 108*a*, 108*b* and are wiped by wipers 112*a*, 112*b* as printhead carrier assembly 14 moves to the left. Maintenance sled 54 stays at wiping elevation 88 until the leftward leading print cartridge 36*b* on printhead carrier assembly 14 engages print latch 98.

During the leftward movement of maintenance sled 54, waste ink spreader 56 moves leftward in conjunction with the generally lateral movement of maintenance sled 54. During the leftward of waste ink spreader 56, trailing curved surface 78 of waste ink spreader 56 further engages and disperses the accumulated ejected ink in waste ink accumulation region 28 as waste ink spreader 56 returns to horizontal elevation 94.

As shown in FIGS. 1–5 and described above, a single waste ink spreader 56 engages the ink ejected from print cartridge 36*a* and accumulated in waste ink accumulation region 28. However, one skilled in the art will recognize that the present invention can be adapted to accommodate ink jet printer systems having multiple pigment based ink cartridges. Where multiple pigment based ink cartridges are used, each ink spreading surface engages ink ejected through a different discharge cavity. Furthermore, a separate dedicated spreader mechanism can be provided for each print cartridge. It is also within the scope of the present invention to incorporate the spreader mechanism as an integral component of the maintenance sled.

By spreading the accumulated ink over a larger surface area of waste ink accumulation region 28, the waste ink storage capacity of printer 10 is increased without increasing the size of the printer or increasing the size of the waste ink reservoir. In addition, by preventing the accumulation of waste ink at levels which would impede the operation of the maintenance sled, the life of the maintenance assembly, and in turn the life of the printer, is increased.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within know or customary practice in the art to which this invention pertains and which fall within the limits of the appended claims.

What is claimed is:

1. A maintenance unit for use in an ink jet printer, said ink jet printer including a printer frame having a waste ink accumulation region, said maintenance unit comprising:

a maintenance frame coupled to said printer frame;

a maintenance sled moveably coupled to said maintenance frame; and a spreader mechanism slidably coupled to said maintenance frame and driveably coupled to said maintenance sled, said spreader mechanism being adapted for movement in at least a first direction independent of a movement of said maintenance sled, wherein said spreader mechanism contacts waste ink to distribute said waste ink over said waste ink accumulation region as said maintenance sled moves relative to said maintenance frame.

2. The maintenance unit of claim 1, wherein said maintenance frame comprises a first vertical member and a second vertical member, said first vertical member having a first guide surface and said second vertical member having a second guide surface.

3. A maintenance unit for use in an ink jet printer, said ink jet printer including a printer frame having a waste ink accumulation region, said maintenance unit comprising:

a maintenance frame coupled to said printer frame, said maintenance frame including a first vertical member and a second vertical member, said first vertical member having a first guide surface and said second vertical member having a second guide surface;

a maintenance sled moveably coupled to said maintenance frame; and a spreader mechanism slidably coupled to said maintenance frame and driveably coupled to said maintenance sled, wherein said spreader mechanism contacts waste ink to distribute said waste ink over said waste ink accumulation region as said maintenance sled moves relative to said maintenance frame, and wherein said spreader mechanism includes a first guide pin and a second guide pin, said spreader mechanism being positioned between said first vertical member and said second vertical member, said first guide pin engaging said first guide surface and said second guide pin engaging said second guide surface.

4. The maintenance unit of claim 3, wherein said spreader mechanism further comprises a drive member for engaging said maintenance sled.

5. The maintenance unit of claim 3, wherein each of said first guide surface and said second guide surface includes a substantially horizontal portion and an inclined portion.

6. The maintenance unit of claim 5, wherein said maintenance sled is movable between a maintenance position and a capping position, and wherein as said maintenance sled moves from said maintenance position to said capping position, said first guide pin and said second guide pin move from said substantially horizontal portion onto said inclined portion of said first guide surface and said second guide surface, respectively, to cause a vertical movement of said spreader mechanism.

7. A maintenance unit for use in an ink jet printer, said ink jet printer including a printer frame having a waste ink accumulation region, said maintenance unit comprising:

a maintenance frame coupled to said printer frame;

a maintenance sled moveably coupled to said maintenance frame; and a spreader mechanism slidably coupled to said maintenance frame and driveably coupled to said maintenance sled, wherein said spreader mechanism only moves linearly relative to said maintenance frame and contacts waste ink to distribute said waste ink over said waste ink accumulation region as said maintenance sled moves relative to said maintenance frame, and wherein said spreader mechanism comprises a body having a first curved surface for contacting said waste ink when said spreader mechanism is driven.

8. The maintenance unit of claim 7, wherein said body further includes a second curved surface spaced from said first curved surface for contacting said waste ink when said spreader mechanism is driven.

9. A maintenance unit for use in an ink jet printer, said ink jet printer including a printer frame having a waste ink accumulation region, said maintenance unit comprising:

a maintenance frame coupled to said printer frame;

a maintenance sled moveably coupled to said maintenance frame; and a spreader mechanism slidably coupled to said maintenance frame and driveably coupled to said maintenance sled, wherein said spreader mechanism contacts waste ink to distribute said waste ink over said waste ink accumulation region as said maintenance sled moves relative to said maintenance frame, and wherein said spreader mechanism comprises:

a spreader body having a leading side;

an extension member extending upward from said leading side;

a first guide member and a second guide member extending co-axially outward from an upper portion of said extension member; and a drive member extending upwardly from an upper central portion of said extension member.

10. The maintenance unit of claim 9, wherein said spreader body further includes a bottom side, a top side, and a trailing side, and wherein said leading side smoothly transitions into said bottom side to form a leading curved surface.

11. The maintenance unit of claim 10, wherein said trailing side smoothly transitions into said bottom side to form a trailing curved surface.

12. An ink jet printer including a printhead having nozzles for ejecting ink, said ink jet printer comprising:

a printer frame having a waste ink accumulation region;

a printhead carrier assembly including a carriage for carrying said printhead, said printhead carrier assembly being mounted to said printer frame, said printhead carrier assembly effecting a reciprocating movement of said printhead through a printing zone during a printing operation and effecting movement of said printhead into a maintenance zone during a maintenance operation, said maintenance zone including a maintenance start position and a maintenance capping region; and a maintenance unit coupled to said printer frame, said maintenance unit including:

a maintenance frame coupled to said printer frame;

a maintenance sled moveably coupled to said maintenance frame; and a spreader mechanism slidably coupled to said maintenance frame and driveably coupled to said maintenance sled, said spreader mechanism being adapted for movement in at least a first direction independent of a movement of said maintenance sled, wherein said spreader mechanism contacts waste ink to distribute said waste ink over said waste ink accumulation region as said maintenance sled moves relative to said maintenance frame.

13. The ink jet printer of claim 12, wherein said maintenance frame comprises a first vertical member and a second vertical member, said first vertical member having a first guide surface and said second vertical member having a second guide surface.

14. An ink jet printer including a printhead having nozzles for ejecting ink, said ink jet printer comprising:

a printer frame having a waste ink accumulation region;

a printhead carrier assembly including a carriage for carrying said printhead, said printhead carrier assembly being mounted to said printer frame, said printhead carrier assembly effecting a reciprocating movement of said printhead through a printing zone during a printing operation and effecting movement of said printhead into a maintenance zone during a maintenance operation, said maintenance zone including a maintenance start position and a maintenance capping region; and a maintenance unit coupled to said printer frame, said maintenance unit including:

a maintenance frame coupled to said printer frame, said maintenance frame including a first vertical member and a second vertical member, said first vertical member having a first guide surface and said second vertical member having a second guide surface;

a maintenance sled moveably coupled to said maintenance frame; and a spreader mechanism slidably coupled to said maintenance frame and driveably coupled to said maintenance sled, wherein said spreader mechanism contacts waste ink to distribute said waste ink over said waste ink accumulation region as said maintenance sled moves relative to said maintenance frame, and wherein said spreader mechanism includes a first guide pin and a second guide pin, said spreader mechanism being positioned between said first vertical member and said second vertical member, said first guide pin engaging said first guide surface and said second guide pin engaging said second guide surface.

15. The ink jet printer of claim 14, wherein said spreader mechanism further comprises a drive member for engaging said maintenance sled.

16. The ink jet printer of claim 14, wherein each of said first guide surface and said second guide surface includes a substantially horizontal portion and an inclined portion.

17. An article of manufacture for use in a maintenance station of an ink jet printer, comprising:

a spreader body having a leading side;

an extension member extending from said leading side;

a first guide member and a second guide member extending co-axially outward from an upper portion of said extension member; and a drive pin extending upwardly from an upper central portion of said extension member.

18. The article of manufacture of claim 17, wherein said spreader body further includes a bottom side, a top side, and a trailing side, and wherein said leading side smoothly transitions into said bottom side to form a leading curved surface.

19. The article of manufacture of claim 18, wherein said trailing side smoothly transitions into said bottom side to form a trailing curved surface.

* * * * *